US011850705B2

(12) United States Patent
Genozono

(10) Patent No.: US 11,850,705 B2
(45) Date of Patent: Dec. 26, 2023

(54) GRINDING APPARATUS

(71) Applicant: DISCO CORPORATION, Tokyo (JP)

(72) Inventor: Jiro Genozono, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 408 days.

(21) Appl. No.: 17/160,748

(22) Filed: Jan. 28, 2021

(65) Prior Publication Data

US 2021/0245326 A1 Aug. 12, 2021

(30) Foreign Application Priority Data

Feb. 10, 2020 (JP) ..... 2020-020540

(51) Int. Cl.
*B24B 55/02* (2006.01)

(52) U.S. Cl.
CPC ..... *B24B 55/02* (2013.01)

(58) Field of Classification Search
CPC ..... B24B 55/02; B24B 55/03; B24B 55/12; B24B 7/228; B24B 37/04; B24B 37/042; B24B 37/10
See application file for complete search history.

(56) References Cited

U.S. PATENT DOCUMENTS

2003/0209523 A1* 11/2003 Padhi ..... H01L 21/32115 257/E21.309

FOREIGN PATENT DOCUMENTS

| | | | | | |
|---|---|---|---|---|---|
| JP | 2011025380 | A | | 2/2011 | |
| JP | 2014166937 | A | | 9/2014 | |
| JP | 2016111147 | A | | 6/2016 | |
| JP | 2018001374 | A | * | 1/2018 | ..... B05C 11/08 |
| KR | 20110060155 | A1 | * | 6/2011 | ..... B24B 37/12 |
| KR | 20180060363 | A1 | * | 6/2018 | ..... B24B 37/04 |

* cited by examiner

*Primary Examiner* — Joel D Crandall
(74) *Attorney, Agent, or Firm* — GREER BURNS & CRAIN, LTD.

(57) ABSTRACT

A grinding apparatus includes a grinding unit, a grinding feeding mechanism, and a grinding water supply unit. The grinding water supply unit includes a nozzle that jets grinding water to grindstones, and a biasing mechanism that biases the nozzle upward. The nozzle is configured to be movable downward against the upward biasing according to a downward movement of the grinding unit. The grinding apparatus further includes an upper limit stopping section that sets an upper limit position for upward movement of the nozzle biased upward by the biasing mechanism, for forming a gap through which the grinding wheel is passed, between the nozzle and the mount.

3 Claims, 6 Drawing Sheets

GRINDING APPARATUS

BACKGROUND OF THE INVENTION

Field of the Invention

The present invention relates to a grinding apparatus.

Description of the Related Art

As disclosed in Japanese Patent No. 6355540 and Japanese Patent No. 6090998, a laser beam is applied to an upper surface of an SiC ingot having an off angle, to form modified layers and cracks inclined by the off angle amount with the modified layers as start points at a predetermined depth position from the upper surface, and the SiC ingot is separated into a thick part and a thin part with the thus formed cracks as start points, whereby an SiC wafer consisting of the thin part is manufactured. Since the cracks are inclined by the off angle amount, the surface generated by the separation of the SiC ingot is rugged. In view of this, for enabling incidence of a laser beam for forming the next SiC wafer, the ruggedness is removed by grinding the upper surface of the SiC ingot by use of a grindstone.

In such grinding, for cooling the grindstone and the SiC ingot and for removing grinding swarf, grinding water is jetted from a grinding water nozzle to the processing area where the upper surface of the SiC ingot and the lower surface of the grindstone make contact with each other, to supply the grinding water to the processing area.

In addition, since the SiC ingot becomes thinner each time the SiC ingot is separated to form the SiC wafer, the height position where the upper surface of the SiC ingot and the lower surface of the grindstone make contact at the time of grinding approaches the lower surface of the SiC ingot (the surface on which the SiC ingot is held) as the SiC ingot becomes thinner. In view of this, for example, as disclosed in Japanese Patent Laid-open No. 2011-025380, a nozzle disposed in the grinding unit is used to make it possible to cope with variations in the position of the processing area where the upper surface of the SiC ingot and the lower surface of the grindstone make contact with each other.

SUMMARY OF THE INVENTION

However, the nozzle disclosed in Japanese Patent Laid-open No. 2011-025380 is connected to the grinding unit and disposed directly below the grindstone, the nozzle serves as an obstacle at the time when the grindstone has been consumed and the grinding wheel on which the grindstone is disposed is to be replaced. Therefore, it is necessary to detach the nozzle or to shift the position of the nozzle. Further, it is necessary to adjust the position by re-disposing the nozzle after replacement of the grinding wheel.

Accordingly, it is an object of the present invention to provide a grinding apparatus configured such that a replacing work for a grinding wheel can be easily carried out.

In accordance with an aspect of the present invention, there is provided a grinding apparatus including a chuck table that holds a workpiece on a holding surface, a grinding unit in which a grinding wheel with grindstones arranged in an annular pattern on a wheel base is connected to a tip end of a mount and the grinding wheel is rotated with a center of the wheel base as an axis to grind the workpiece held on the holding surface, a grinding feeding mechanism that moves the grinding unit in a vertical direction perpendicular to the holding surface, and a grinding water supply unit that supplies grinding water to a processing area where an upper surface of the workpiece held on the holding surface and a lower surface of the grindstones make contact with each other. The grinding water supply unit includes a nozzle that jets the grinding water to the grindstones and a biasing mechanism that biases the nozzle upward. The nozzle is configured to be movable downward against the upward biasing according to a downward movement of the grinding unit. The grinding apparatus includes an upper limit stopping section that sets an upper limit position for upward movement of the nozzle biased upward by the biasing mechanism, for forming a gap through which the grinding wheel is passed, between the nozzle biased upward by the biasing mechanism and the mount of the grinding unit moved upward by the grinding feeding mechanism.

According to one aspect of the present invention, a limit position for upward movement of the nozzle biased upward is set by the upper limit stopping section, and therefore, the nozzle does not follow up to the upward movement of the grinding unit at the limit position, even if the grinding unit is moved to a higher position. Accordingly, a gap through which the grinding wheel can be replaced is formed between the mount and the nozzle, a replacing work for the grinding wheel is facilitated, and the work time can be shortened.

In addition, since the work of re-disposing the nozzle is unnecessitated at the time of replacing the grinding wheel, the jetting position of grinding water is not shifted attendant on the re-disposing of the nozzle, and the arriving position of the grinding water jetted from the nozzle is not changed.

The above and other objects, features and advantages of the present invention and the manner of realizing them will become more apparent, and the invention itself will best be understood from a study of the following description and an appended claim with reference to the attached drawings showing a preferred embodiment of the invention.

DETAILED DESCRIPTION OF THE PREFERRED EMBODIMENT

An embodiment of the present invention will be described below referring to the attached drawings.

1. Configuration of Grinding Apparatus

Figure 1:
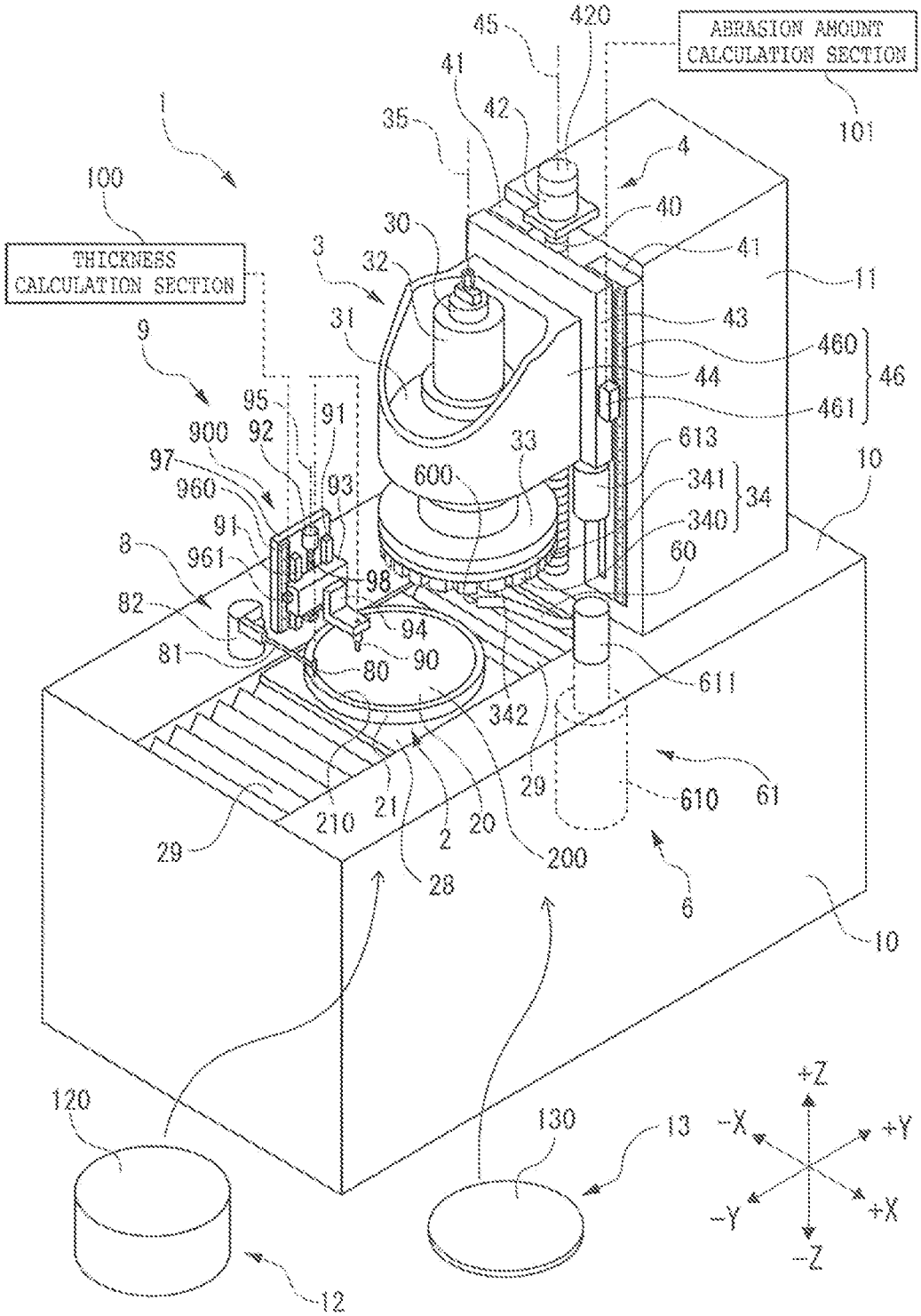
FIG. 1 is a perspective view of a grinding apparatus as a whole.

A grinding apparatus 1 depicted in FIG. 1 is a grinding apparatus for grinding an SiC ingot as an example of a workpiece or a wafer 13 formed by slicing the ingot 12 into an appropriate thickness by use of a grindstone 340.

As depicted in FIG. 1, the grinding apparatus 1 includes a base 10 extended in a Y-axis direction, and a column 11 erected at a +Y direction side position on the base 10.

A grinding feeding mechanism 4 supporting a grinding unit 3 is disposed on a side surface on a −Y direction side of the column 11. The grinding unit 3 includes a spindle 30 having a rotational axis 35 parallel to a Z-axis direction, a housing 31 supporting the spindle 30 in a rotatable manner, a spindle motor 32 rotationally driving the spindle 30 with the rotational axis 35 as an axis, an annular mount 33 connected to a lower end of the spindle 30, and a grinding wheel 34 detachably attached to a lower surface of the mount 33. The grinding wheel 34 includes a wheel base 341, and a plurality of grindstones 340 having a substantially rectangular parallelepiped shape and arranged in an annular pattern on a lower surface of the wheel base 341, and lower surfaces 342 of the grindstone 340 are grinding surfaces that grind the workpiece.

By rotating the spindle 30 with the rotational axis 35 as an axis by use of the spindle motor 32, the mount 33 connected to the spindle 30 and the grinding wheel 34 mounted to the mount 33 are rotated around the rotational axis 35 passing through the center of the wheel base 341 and extending in the Z-axis direction.

The grinding feeding mechanism 4 includes a ball screw 40 having a rotational axis 45 parallel to the Z-axis direction, a pair of guide rails 41 disposed in parallel to the ball screw 40, a Z-axis motor 42 connected to an upper end of the ball screw 40 and rotating the ball screw 40 with the rotational axis 45 as an axis, an encoder 420 for measurement, control, and the like of the rotating amount of the Z-axis motor 42, a lift plate 43 whose nut in the inside thereof is screw engaged with the ball screw 40 and those side parts make sliding contact with the guide rails 41, and a holder 44 connected to the lift plate 43 and holding the spindle 30.

With the ball screw 40 rotated around the rotational axis 45 by driving the ball screw 40 by use of the Z-axis motor 42, the lift plate 43 is moved upward and downward in the Z-axis direction while being guided by the guide rails 41. Attendant on this, the grinding unit 3 held by the holder 44 is moved in the vertical direction (Z-axis direction) perpendicular to a holding surface 200 of a chuck table 2.

The grinding apparatus 1 includes a height recognition unit 46 that recognize the height of the grinding unit 3. The height recognition unit 46 includes, for example, a scale 460 disposed on a side surface on the −Y direction side of the guide rails 41, and, for example, a height recognition section 461 disposed at a position on a side surface on the +X direction side of the lift plate 43 and adjacent to the scale 460. The height recognition section 461 is a block having, for example, an optical type recognition mechanism or the like for reading light reflected from a graduation formed on the scale 460. By reading the graduation of the scale 460 by use of the height recognition section 461, the height of the grinding unit 3 can be recognized.

The chuck table 2 is disposed on the base 10. The chuck table 2 includes a disk-shaped suction section 20 and an annular frame body 21 supporting the suction section 20. An upper surface of the suction section 20 is the holding surface 200 on which to suction hold the ingot 12 or the wafer 13, and an upper surface 210 of the frame body 21 is formed to be flush with the holding surface 200.

A cover 28 is disposed in the periphery of the chuck table 2, and the cover 28 is connected to a bellows 29 capable of contraction and extension.

When the chuck table 2 is moved in the Y-axis direction, the cover 28 is moved in the Y-axis direction as one body with the chuck table 2, and the bellows 29 is contracted or extended.

A holding surface height measuring instrument 8 for measuring the height of the holding surface 200 is disposed on the base 10. The holding surface height measuring instrument 8 includes a housing 82 disposed on the −X direction side on the base 10, an arm 81 having an end portion connected to a side surface of the housing 82, and a probe 80 connected to an end portion not connected to the housing 82 of the arm 81.

With a lower end of the probe 80 put into contact with the upper surface 210 of the frame body 21, the height of the holding surface 200 flush with the upper surface 210 of the frame body 21 can be measured.

An upper surface height measuring instrument 9 for measuring the height of an upper surface of the workpiece is disposed in the vicinity of the holding surface height measuring instrument 8. The upper surface height measuring instrument 9 includes a probe 90, and a moving mechanism 900 that moves the probe 90 upward and downward in the Z-axis direction.

The moving mechanism 900 includes a back plate 97 erected on the base 10, a ball screw 98 disposed on a side surface on the +X direction side of the back plate 97 and having an axis in the Z-axis direction, a motor 92 for rotating the ball screw 98, a pair of guide rails 91 disposed in parallel to the ball screw 98, a movable plate 93 whose nut at a side portion thereof is screw engaged with the ball screw 98 and which makes sliding contact with the guide rails 91, and an L-shaped jig 94 connected to a side surface on the +X direction side of the movable plate 93.

The probe 90 is supported on a lower surface of the L-shaped jig 94.

When the ball screw 98 is rotated by driving the ball screw 98 by use of the motor 92, the movable plate 93 is moved upward or downward in the Z-axis direction while being guided by the guide rails 91, and the L-shaped jig 94 connected to the movable plate 93 and the probe 90 supported by the L-shaped jig 94 are moved as one body upward or downward in the Z-axis direction.

At a position adjacent to the guide rails 91, of a side surface on the +X direction side of the back plate 97, a scale 960 is disposed in parallel to the guide rails 91, and an optical type reading section 961 is disposed at a side surface on the −Y direction side of the movable plate 93.

For example, by reading the graduation formed on the scale 960 by the reading section 961 and recognizing the height position of the movable plate 93, in a state in which the probe 90 is in contact with the upper surface 120 of the ingot 12 held on the holding surface 200, the height of the upper surface 120 of the ingot 12 can be measured. Similarly, by use of the upper surface height measuring instrument 9, the height of the upper surface 130 of the wafer 13 can also be measured.

A thickness calculation section 100 is connected to the probe 80, the probe 90, and the reading section 961.

Information concerning the height of the holding surface 200 and the height of the upper surface of the workpiece measured by the holding surface height measuring instrument 8 and the upper surface height measuring instrument 9 is transmitted as electrical signals to the thickness calculation section 100.

The thickness calculation section 100 can calculate the thickness of the workpiece by subtracting the height of the holding surface 200 measured by the holding surface height measuring instrument 8 from the height of the upper surface of the workpiece measured by the upper surface height measuring instrument 9.

Figure 2:
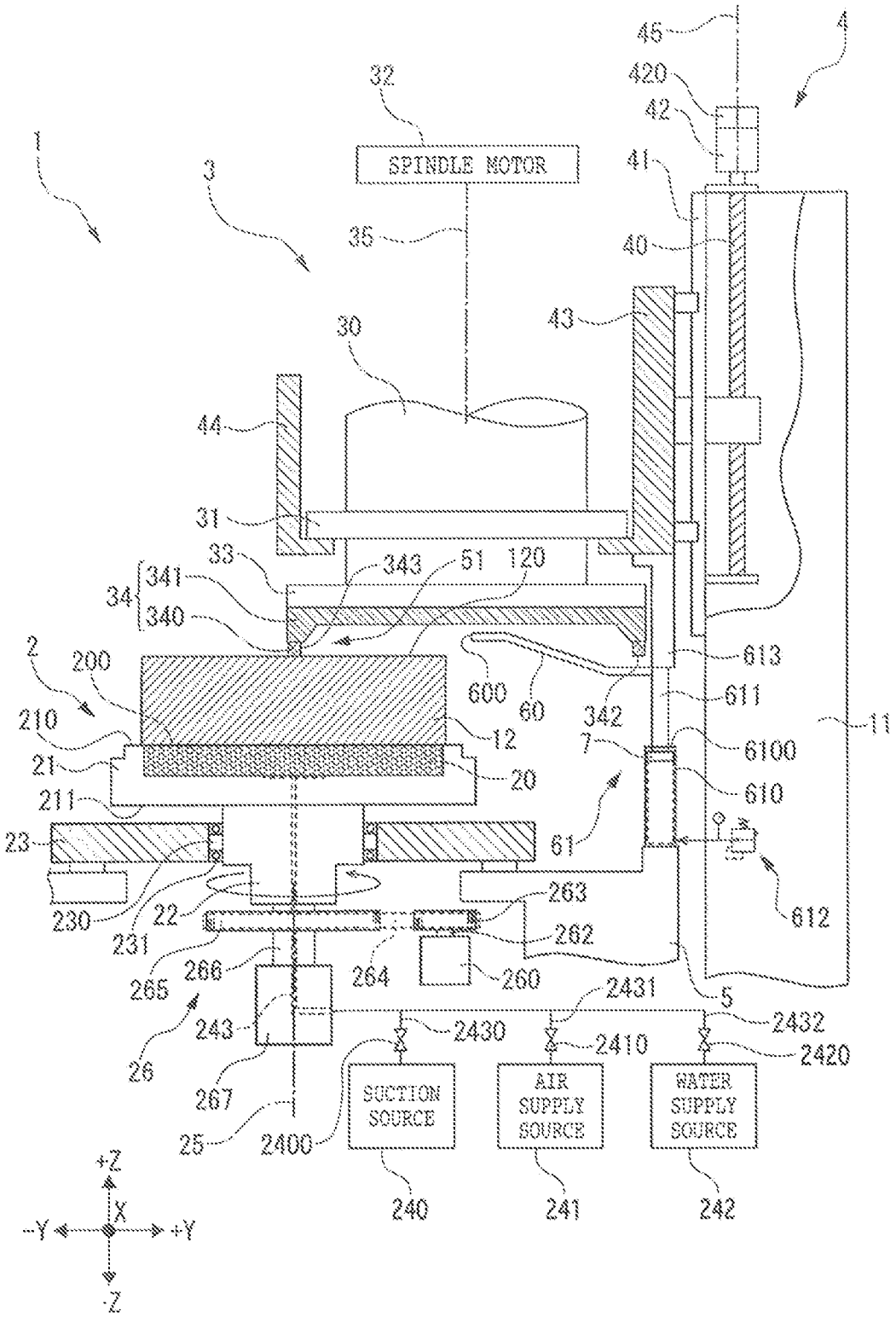
FIG. 2 is a sectional view of the manner of grinding an ingot, as viewed from a lateral side of the grinding apparatus.

As depicted in FIG. 2, a base 22 is connected to a lower surface 211 of the frame body 21 of the chuck table 2.

An annular member 23 is disposed in the periphery of the base 22. The annular member 23 has an opening 230, and the base 22 penetrates the opening 230. In the annular member 23, a support section 231 disposed on an inside surface of the annular shape supports the base 22 in a rotatable manner. In addition, the annular member 23 is supported by an inside base 5 disposed in the inside of the grinding apparatus 1.

A rotating mechanism 26 for rotating the base 22 is disposed on a lower side of the chuck table 2. A motor 260 is disposed in the rotating mechanism 26.

The rotating mechanism 26 is, for example, a pulley mechanism, and includes a driving shaft 262 rotatable with an axis parallel to the Z-axis direction as an axis by the motor 260, a driving pulley 263 connected to an upper end of the driving shaft 262, a transmission belt 264 wound around the driving pulley 263 and transmitting a driving force of the driving pulley 263 to a driven pulley 265, the driven pulley 265 around which the transmission belt 264 is wound like around the driving pulley 263, a driven shaft 266 connected to the driven pulley 265, and a rotary joint 267 connected to a lower end of the driven shaft 266. The driven shaft 266 is connected to the base 22.

When the driving shaft 262 is rotated by use of the motor 260, the driving pulley 263 is rotated, and a rotating force of the driving pulley 263 is transmitted to the driven pulley 265 by the transmission belt 264, to rotate the driven pulley 265. As a result, the driven shaft 266 connected to the driven pulley 265 is rotated with a rotational axis 25 parallel to the Z-axis direction as an axis, and the base 22 connected to the driven shaft 266 is rotated with the rotational axis 25 parallel to the Z-axis direction as an axis.

A suction source 240 connected to the suction section 20 through a flow channel 243, an air supply source 241, and a water supply source 242 are disposed on a lower side of the chuck table 2.

The flow channel 243 is formed, for example, to penetrate the inside of the frame body 21, the base 22, the driven shaft 266, and the rotary joint 267, and projects from a side surface of the rotary joint 267 to the outside of the rotary joint 267, to be branched into a suction passage 2430, an air channel 2431, and a water channel 2432.

A suction valve 2400 is disposed between the suction source 240 and the suction section 20. When the suction source 240 is operated in a state in which the suction valve 2400 is open, a suction force generated by the suction source 240 is transmitted through the flow channel 243 to the holding surface 200 of the suction section 20.

For example, by opening the suction valve 2400 and operating the suction source 240 in a state in which the ingot 12 is placed on the holding surface 200, the ingot 12 can be suction held on the holding surface 200.

In addition, an air valve 2410 is disposed between the air supply source 241 and the suction section 20. When air is supplied by use of the air supply source 241 in a state in which the air valve 2410 is open, the air supplied is transmitted through the flow channel 243 to the suction section 20 and is jetted in the +Z direction through a multiplicity of minute holes formed in the holding surface 200.

For example, when air is jetted from the multiplicity of minute holes in the holding surface 200 by opening the air valve 2410 and operating the air supply source 241 in a state in which the workpiece or the like is not placed on the holding surface 200, grinding swarf and the like adhering to the inside of the suction section 20 and the holding surface 200 can be thereby removed.

A water valve 2420 is disposed between the water supply source 242 and the suction section 20. When water is supplied from the water supply source 242 in a state in which the water valve 2420 is open, the water supplied is transmitted through the flow channel 243 to the suction section 20, to be jetted through the multiplicity of minute holes in the holding surface 200.

For example, when water is jetted from the multiplicity of minute holes in the holding surface 200 by opening the water valve 2420 and operating the water supply source 242 in a state in which the workpiece or the like is not placed on the holding surface 200, the holding surface 200 can be thereby cleaned. In this instance, the air valve 2410 may be opened to jet air together with water.

The grinding apparatus 1 includes a grinding water supply unit 6. The grinding water supply unit 6 has a function of supplying grinding water to a processing area where the upper surface of the workpiece held by the holding surface 200 and the lower surfaces 342 of the grindstones 340 make contact with each other.

The grinding water supply unit 6 includes a nozzle 60 for jetting grinding water to the grindstones 340, and a biasing mechanism 61 for biasing the nozzle 60 in an upward direction (+Z direction).

The biasing mechanism 61 includes an air cylinder 610 disposed on the inside base 5 and a piston rod 611 accommodated in the air cylinder 610.

The air cylinder 610 has a raised bottom surface 6100 formed with an opening in a central portion thereof. The outside diameter of the piston rod 611 is formed to be smaller than the diameter of the opening, and the piston rod 611 penetrates the opening in the Z-axis direction.

In addition, an air supply source 612 for supplying air to the inside of the air cylinder 610 is connected to the air cylinder 610.

When a pressing force in the +Z direction is exerted on a lower surface of the piston rod 611 by supplying air to the inside of the air cylinder 610 by use of the air supply source 612, the piston rod 611 is moved upward in the +Z direction within a space inside the air cylinder 610. As a result, the piston rod 611 projects to above the air cylinder 610, and the nozzle 60 connected to the piston rod 611 is biased in the +Z direction.

For example, by continuing the supply of a predetermined flow rate of air from the air supply source 612 to the inside of the air cylinder 610, a state in which the piston rod 611 projects to above the air cylinder 610 is maintained, and a state in which the nozzle 60 connected to the piston rod 611 is biased in the +Z direction is maintained.

An upper limit stopping section 7 that sets an upper limit position for the nozzle 60 biased in the upward direction (+Z direction) by the biasing mechanism 61 is connected to a lower end of the piston rod 611. The upper limit stopping section 7 is formed in a cylindrical shape, and its bottom surface has a diameter larger than that of the opening in the raised bottom surface 6100 of the air cylinder 610.

When the piston rod 611 is biased in the +Z direction to move to a predetermined height position by supplying air to the air cylinder 610, the upper limit stopping section 7 makes contact with the raised bottom surface 6100 of the air cylinder 610. As a result, upward movement of the piston rod 611 is inhibited, resulting in a state in which the piston rod 611 and the nozzle 60 cannot move upward any more.

The nozzle 60 is a tubular member, and its one end is connected to a side surface of the piston rod 611. The nozzle 60 is extended, for example, from the side surface of the piston rod 611 in a direction substantially perpendicular to the height direction (Z axis direction) of the piston rod 611.

The nozzle 60 is formed at the other end thereof with a jet port 600 for jetting grinding water. Further, the nozzle 60 is connected to a grinding water supply source which is not depicted. The nozzle 60 has an inclined section which is inclined such as to be located at an upper position in going toward the jet port 600. In other words, the jet port 600 is formed at a position higher than the position of a base of the nozzle 60 connected to the side surface of the piston rod 611.

When grinding water is supplied to the nozzle 60 by use of the grinding water supply source, the grinding water is jetted from the jet port 600 of the nozzle 60.

For example, by supplying grinding water to the nozzle 60 by use of the grinding water supply source in a state in which the chuck table 2 is positioned at a horizontal position (Y-axis position) at the time of grinding the workpiece, the grinding water can be jetted from the jet port 600 of the nozzle 60 toward the chuck table 2. Specifically, the grinding water can be jetted from the jet port 600 of the nozzle 60 to the processing area where the upper surface of the workpiece held on the holding surface 200 at the time of grinding and the lower surfaces 342 of the grindstones 340 make contact with each other.

Hereinafter, the area where the upper surface 120 of the ingot 12 held on the holding surface 200 depicted in FIG. 2 and the lower surfaces 342 of the grindstones 340 make contact with each other will be referred to as a first processing area 51.

Figure 3:
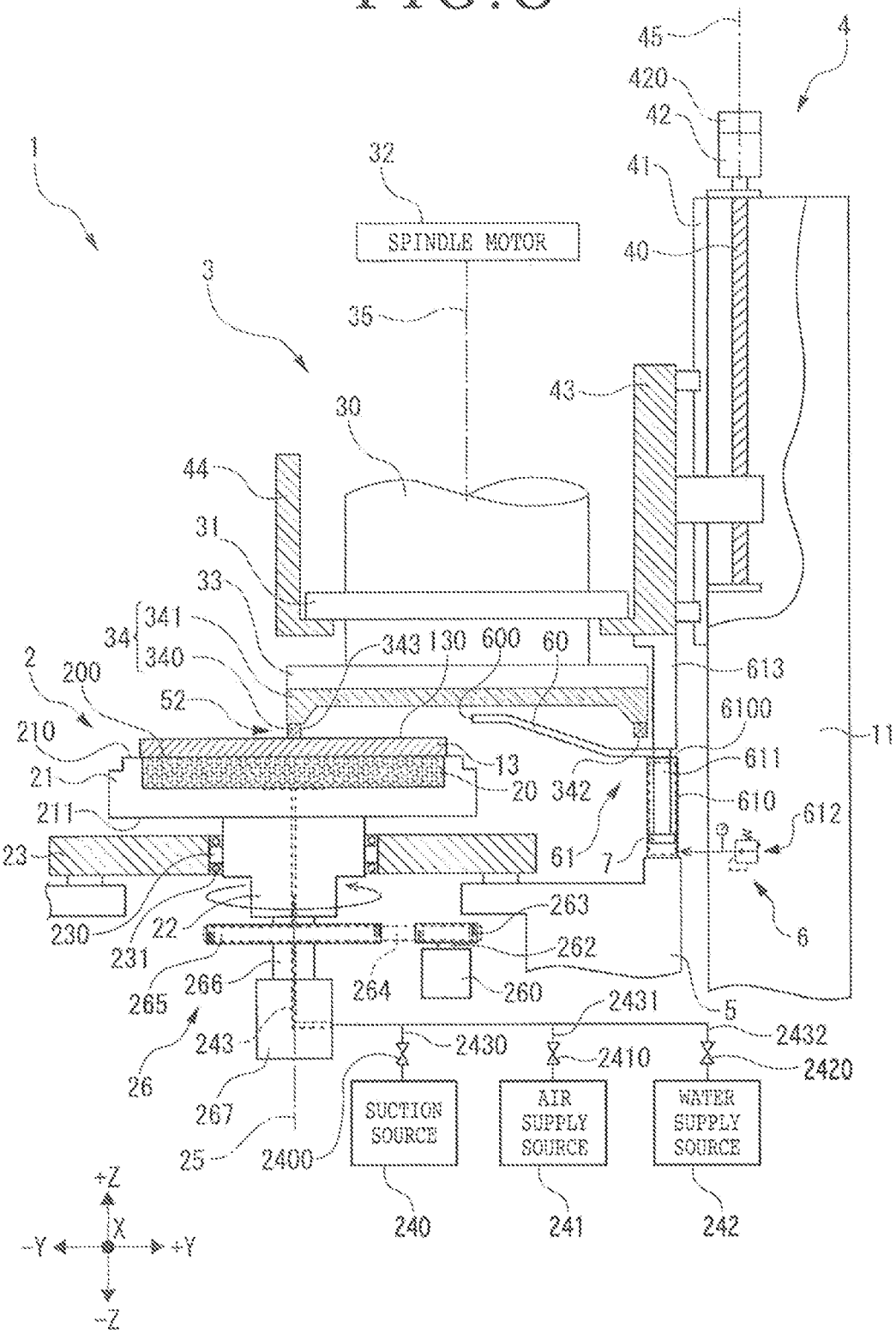
FIG. 3 is a sectional view of the manner of grinding a wafer, as viewed from a lateral side of the grinding apparatus.

In addition, the area where the upper surface 130 of the wafer 13 held on the holding surface 200 depicted in FIG. 3 and the lower surfaces 342 of the grindstones 340 make contact with each other will be referred to as a second processing area 52.

On a lower surface of the lift plate 43, a presser member 613 is disposed in the state of drooping in the −Z direction from the lower surface of the lift plate 43.

By lowering the lift plate 43 in the −Z direction by rotating the Z-axis motor 42 of the grinding feeding mechanism 4, the presser member 613 disposed on the lower surface of the lift plate 43 is lowered in the −Z direction as one body with the lift plate 43, and a lower surface of the presser member 613 and an upper surface of the piston rod 611 make contact with each other.

By moving the presser member 613 further in the −Z direction in a state in which the lower surface of the presser member 613 and the upper surface of the piston rod 611 are in contact with each other, the piston rod 611 can be pushed in the −Z direction.

A lower end of the presser member 613 is located below the lower surfaces 342 of the grindstones 340. Since the nozzle 60 extends from a side surface of the piston rod 611 in a direction substantially perpendicular to the height direction (Z-axis direction), the nozzle 60 and the grindstones 340 do not make contact with each other even if the grinding unit 3 is lowered. In the example depicted, when the presser member 613 is in contact with and pressing the piston rod 611, the jet port 600 is located at a position slightly above the lower surfaces 342 of the grindstones 340 and is located on the inside of a rotational track of the grindstones 340. In addition, a tip end of the jet port 600 is directed toward the inside of the rotational track of the grindstones 340.

Note that the presser member may be a wheel cover disposed in the housing 31 or the holder 44 such as to surround the annular grindstones.

2. Operation of Grinding Apparatus (1) Grinding of Ingot

An operation of the grinding apparatus 1 at the time of grinding the ingot 12 by use of the grinding apparatus 1 will be described.

At the time of grinding the ingot 12 by use of the grinding apparatus 1, first, as depicted in FIG. 2, the ingot 12 is placed on the holding surface 200 of the chuck table 2. Then, the suction valve 2400 is opened. As a result, a suction force generated from the suction source 240 is transmitted through the flow channel 243 to the holding surface 200, whereby the ingot 12 is suction held on the holding surface 200.

In the state in which the ingot 12 is suction held on the holding surface 200, the chuck table 2 is moved in the +Y direction by use of a Y-axis moving mechanism, not depicted or the like and is located on a lower side of the grinding unit 3.

Next, the chuck table 2 is rotated with the rotational axis 25 as an axis by use of the rotating mechanism 26, whereby the ingot 12 held on the holding surface 200 is rotated, and the grindstones 340 are rotated with the rotational axis 35 as an axis by use of the spindle motor 32.

Besides, air is supplied from the air supply source 612 of the biasing mechanism 61 to the inside of the air cylinder 610, whereby the nozzle 60 connected to the piston rod 611 is biased in an upward direction (+Z direction).

In a state in which the ingot 12 is being rotated with the rotational axis 25 as an axis and the grindstone 340 are being rotated with the rotational axis 35 as an axis, the grindstone 340 are lowered in the −Z direction by use of the grinding feeding mechanism 4, whereby the lower surfaces 342 of the grindstones 340 are brought into contact with the upper surface of the ingot 12.

In a state in which the lower surfaces 342 are in contact with the upper surface 120 of the ingot 12, the grindstone 340 are further lowered in the −Z direction, whereby the ingot 12 is ground. Since the presser member 613 presses the piston rod 611 in the −Z direction during grinding of the ingot 12, the nozzle 60 is also lowered in the same direction in an attendant manner.

In this instance, grinding water is supplied to the nozzle 60 from the grinding water supply source which is not depicted, and the grinding water is jetted from the jet port 600. As described above, the nozzle 60 is preliminarily adjusted in such a manner that when the presser member 613 is in contact with and pressing the piston rod 611, the jet port 600 is located at a position slightly above the lower surfaces 342 of the grindstones 340 and is located on the inside of the rotational track of the grindstones 340. Therefore, the grinding water jetted from the jet port 600 of the nozzle 60 is supplied to the first processing area 51 which is an area of contact between the lower surfaces 342 and the upper surface 120 of the ingot 12, and grinding swarf generated by grinding and the like are removed by flowing water. In addition, frictional heat generated between the lower surfaces 342 and the upper surface 120 of the ingot 12 attendant on the grinding and the like are removed in practice.

(2) Grinding of Wafer

An operation of the grinding apparatus 1 at the time of grinding the wafer 13 by use of the grinding apparatus 1 will be described.

At the time of grinding the wafer 13 by use of the grinding apparatus 1, first, as depicted in FIG. 3, the wafer 13 is placed on the holding surface 200 of the chuck table 2. Then, in a state in which the suction valve 2400 is open, the suction source 240 is operated. As a result, a suction force generated from the suction source 240 is transmitted through the flow channel 243 to the holding surface 200, whereby the wafer 13 is suction held on the holding surface 200.

In the state in which the wafer 13 is suction held on the holding surface 200, the chuck table 2 is moved in the +Y direction by use of the Y-axis moving mechanism, not depicted, or the like, to be positioned on a lower side of the grinding unit 3.

Next, the chuck table 2 is rotated with the rotational axis 25 as an axis by use of the rotating mechanism 26, whereby the wafer 13 held on the holding surface 200 is rotated, and the grindstones 340 are rotated with the rotational axis 35 as an axis by use of the spindle motor 32.

In addition, air is supplied from the air supply source 612 of the biasing mechanism 61 to the inside of the air cylinder 610, whereby the nozzle 60 connected to the piston rod 611 is biased in an upward direction (+Z direction).

In a state in which the wafer 13 is being rotated with the rotational axis 25 as an axis and the grindstones 340 are being rotated with the rotational axis 35 as an axis, the grinding unit 3 is lowered in the −Z direction by use of the grinding feeding mechanism 4.

With the grindstones 340 lowered in the −Z direction, the lower surfaces 342 of the grindstones 340 come into contact with the upper surface 130 of the wafer 13.

With the grindstones 340 further lowered in the −Z direction in the state in which the lower surfaces 342 are in contact with the upper surface 130 of the wafer 13, the wafer 13 is ground.

In addition, when the grinding unit 3 is lowered in the −Z direction, the upper surface of the piston rod 611 makes contact with the lower surface of the presser member 613 connected to the lift plate 43. When the grinding unit 3 is further lowered in the −Z direction by use of the grinding feeding mechanism 4 in the state in which the upper surface of the piston rod 611 is in contact with the lower surface of the presser member 613, the upper surface of the piston rod 611 is pressed down in the −Z direction by the presser member 613. As a result, the nozzle 60 connected to the piston rod 611 is lowered in the −Z direction as one body with the piston rod 611.

In a state in which the grinding unit 3 is lowered in the −Z direction by a predetermined distance and the lower surfaces 342 of the grindstones 340 are in contact with the upper surface 130 of the wafer 13, the nozzle 60 lowered in the −Z direction attendant on the lowering of the grinding unit 3 is positioned at a suitable height position for jetting grinding water to the second processing area where the upper surface 130 of the wafer 13 held on the holding surface 200 and the lower surfaces 342 of the grindstones 340 make contact with each other.

By supplying grinding water from the grinding water supply source to the nozzle 60 similarly to at the time of grinding the ingot 12, the grinding water is jetted from the jet port 600 of the nozzle 60, to be supplied to the second processing area 52 which is the area of contact between the upper surface 130 of the wafer 13 and the lower surfaces 342 of the grindstones 340. As a result, grinding swarf generated at the upper surface 130 of the wafer 13 upon grinding and the like are removed. In addition, removal of frictional heat generated between the lower surfaces 342 and the upper surface 130 of the wafer 13 attendant on grinding and the like is realized. Since the height position of the nozzle 60 is dependent on the position of the piston rod 611 pressed by the presser member 613, the height position of the jet port 600 is automatically varied according to the thickness of the workpiece. Therefore, it is unnecessary to change the attaching position of the nozzle 60, even in the case of grinding the wafer 13 which is a workpiece thinner than the ingot 12.

(3) Replacement of Grinding Wheel

In the grinding apparatus 1, for example, after grinding of the workpiece and the like, replacement of the grinding wheel 34 of the grinding unit 3 possessed by the grinding apparatus 1 is conducted. An operation of the grinding apparatus 1 at the time of replacing the grinding wheel 34 will be described.

At the time of grinding the workpiece, a pushing-up force in an upward direction (+Z direction) by the biasing mechanism 61 and a pressing load in the −Z direction by the presser member 613 are exerted on the nozzle 60.

After the grinding is finished, the grinding unit 3 is moved upward by use of the grinding feeding mechanism 4. As a result, the presser member 613 is separated from the upper surface of the piston rod 611, and the pressing load in the −Z direction having been exerted from the presser member 613 on the piston rod 611 is removed.

Then, by the action of the upward pushing-up force exerted from the biasing mechanism 61 on the piston rod 611, the piston rod 611 and the nozzle 60 are moved upward. Since the upward movement of the nozzle 60 is stopped at an upper limit position by the upper limit stopping section 7, a gap through which the grinding wheel 34 can be passed for replacement is formed between the nozzle 60 and the mount 33 of the grinding unit 3 having been moved upward by being driven by the grinding feeding mechanism 4. Therefore, at the time of replacing the grinding wheel 34, it is unnecessary to detach or shift the nozzle 60, and it is unnecessary to re-dispose the nozzle 60, so that the jetting position of the grinding water can be prevented from being shifted.

Figure 4:
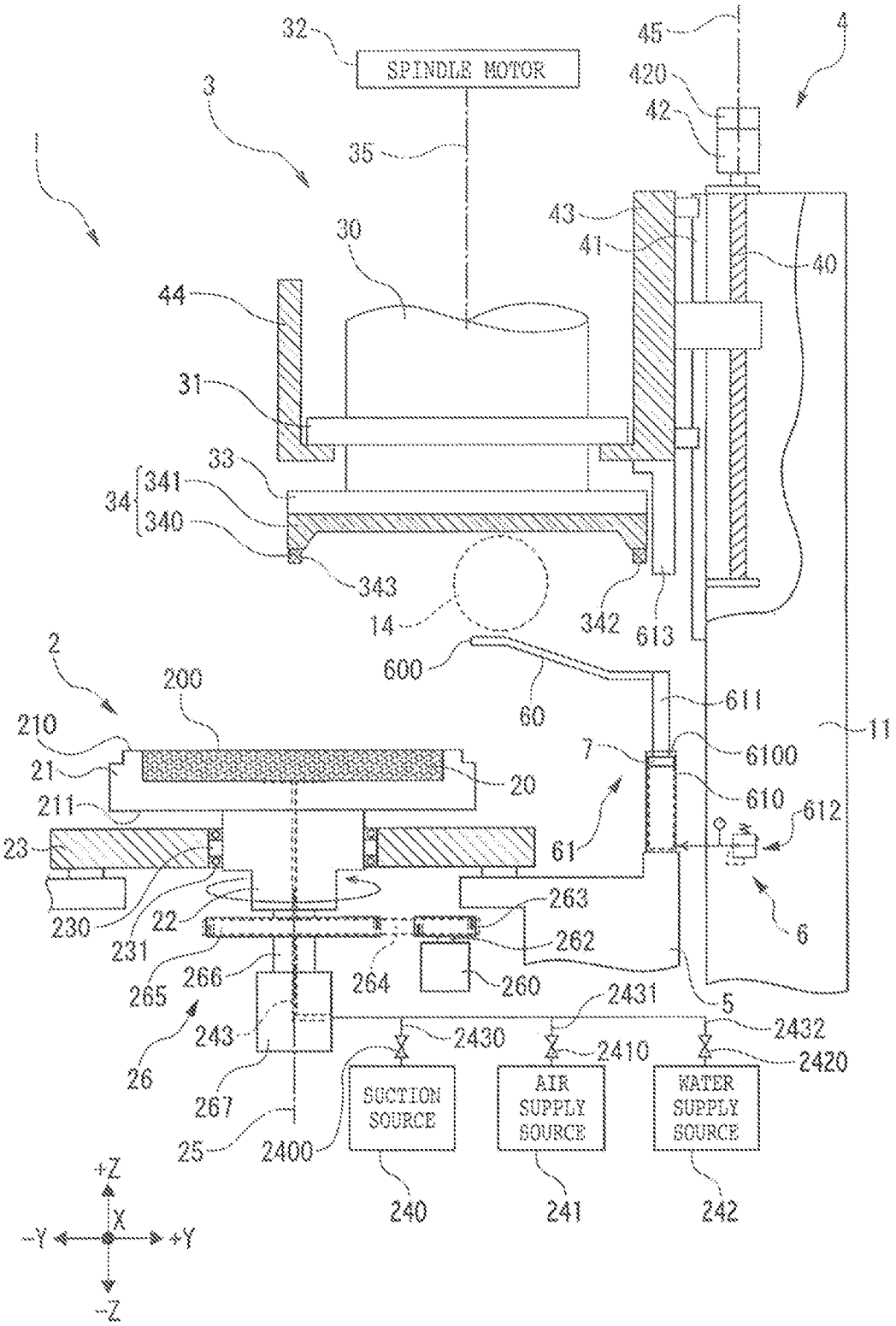
FIG. 4 is a sectional view of the manner of replacing a grinding wheel, as viewed from a lateral side of the grinding apparatus.

As has been described above, in the grinding apparatus 1 of the present embodiment, the limit position for upward movement (upper limit position) of the nozzle 60 biased upward is set by the upper limit stopping section 7, and therefore, even if the grinding unit 3 is moved to a higher position, the nozzle 60 moved upward does not follow up to the upward movement of the grinding unit 3 at the limit position. Since the grindstone 340 are largely spaced from the nozzle 60 when the grinding unit 3 is moved up to a highest position as depicted in FIG. 4, a replacing work for the grinding wheel 34 can be facilitated, and the work time can be shortened.

In addition, since the work of re-disposing the nozzle 60 at the time of replacing the grinding wheel 34 is unnecessitated, the jetting position of the grinding water is not shifted attendant on the re-disposing of the nozzle 60, and the arriving position of the grinding water jetted from the nozzle 60 is not changed.

Further, by adjusting the position of the nozzle 60 in such a manner that in a state in which the grindstone 340 are not in contact with the workpiece, the jet port 600 of the nozzle 60 is positioned at a position on the inside of the rotational track of the grindstones 340 and above the upper surface of the workpiece, water is jetted from the jet port 600 before the presser member 613 makes contact with the piston rod 611 at the time of lowering the grinding unit 3, whereby the grinding water can be made to collide on the lower surfaces 342 and inside surfaces 343 of the grindstones 340, and the lower surfaces 342 and the inside surfaces 343 of the grindstones 340 can be cleaned. As a result, when the lower surfaces 342 of the grindstones 340 make contact with the upper surface 120 of the ingot 12, formation of large scratches due to biting-in of grinding swarf can be prevented.

Figure 5:
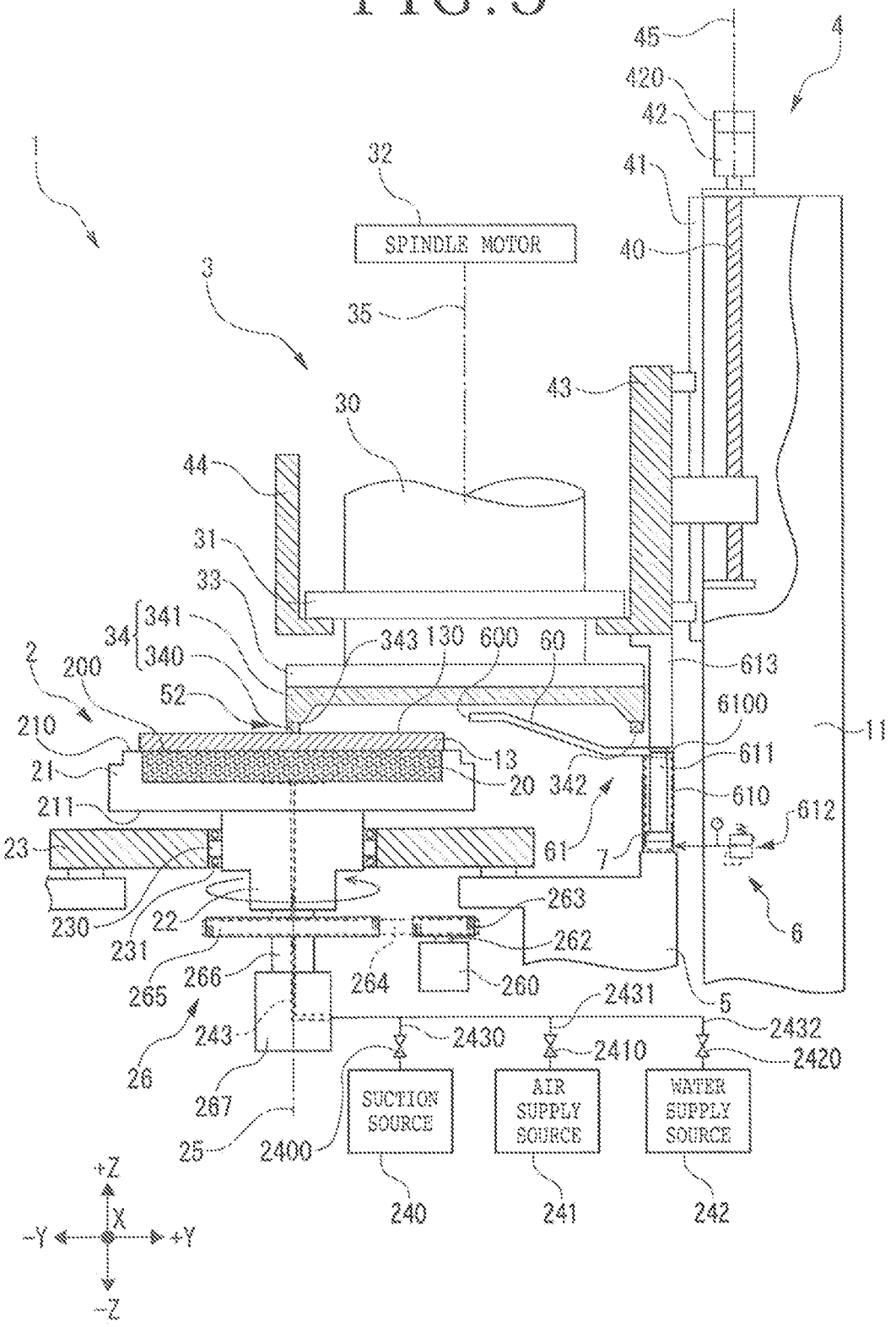
FIG. 5 is a sectional view of the manner of grinding a wafer in the case where abrasion amount of a grindstone is large, as viewed from a lateral side of the grinding apparatus.
Figure 6:
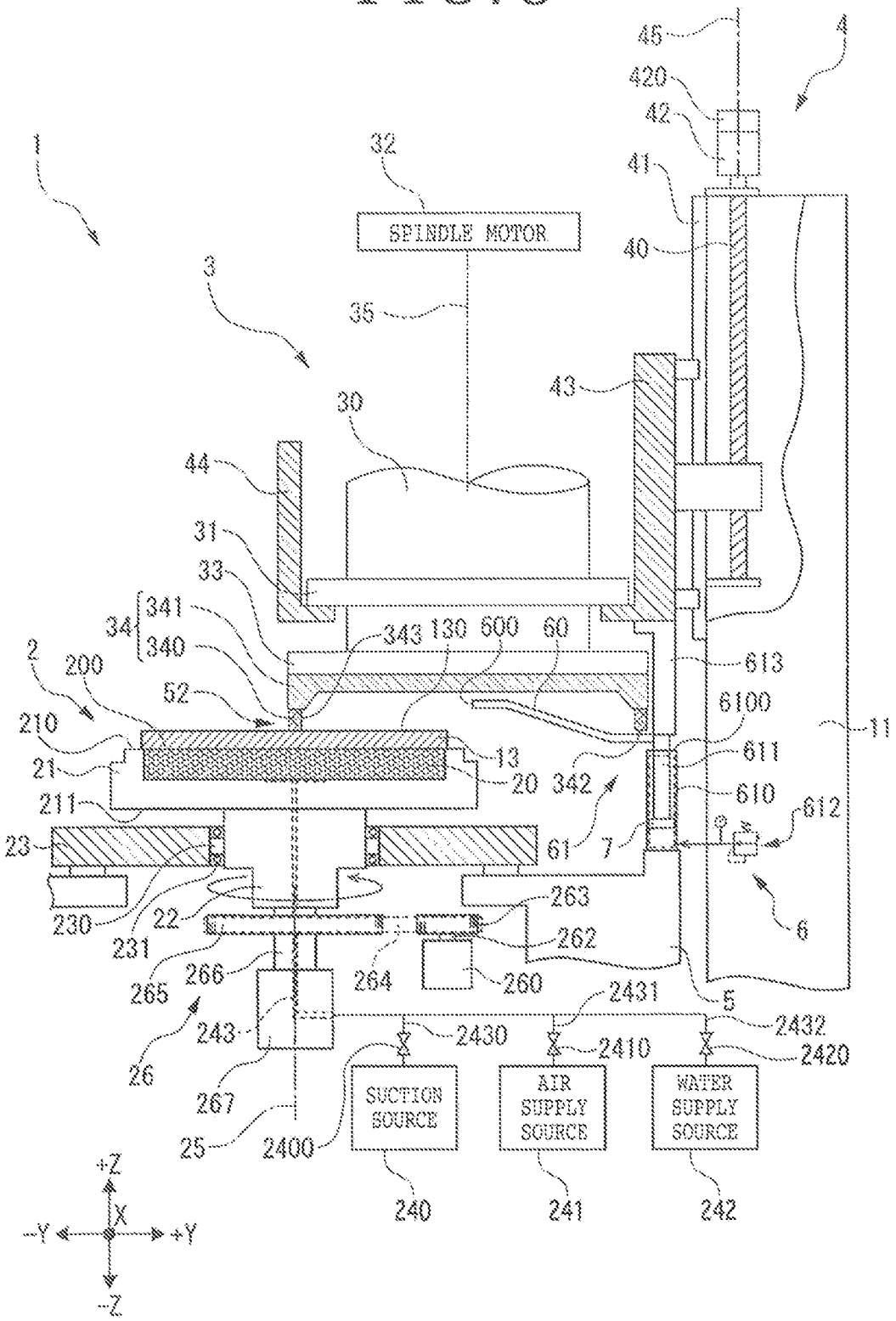
FIG. 6 is a sectional view of the manner of grinding a wafer in the case where abrasion amount of the grindstone is small, as viewed from a lateral side of the grinding apparatus.

In addition, in the case where the residual amount of the grindstones 340 is small as depicted in FIG. 5, the sinking-in amount of the piston rod 611 inside the air cylinder 610 is large, whereas in the case where the residual amount of the grindstones 340 is large, the sinking-in amount of the piston rod 611 inside the air cylinder 610 is small. Therefore, by preliminarily adjusting the position of the nozzle 60 in such a manner that in a state in which the grindstones 340 largely abraded and having a small residual amount are in contact with the workpiece, the jet port 600 of the nozzle 60 is positioned at a position on the inside of the rotational track of the grindstones 340 and above the upper surface of the workpiece, grinding water can be supplied to the position of contact between the upper surface of the workpiece and the lower surfaces 342 of the grindstones 340 in both of the above-mentioned cases.

Note that the upper limit stopping section 7 may stop the upward movement of the nozzle 60 by the biasing mechanism 61, by making contact with an upper portion of the nozzle 60 before the piston rod 611 reaches the upper limit height position. As a further example of the upper limit stopping section 7, there may be contemplated one in which, for example, the base 10 depicted in FIG. 1 includes a shaft section, not depicted, extended in the Z-axis direction, and an arm section, not depicted, extended substantially perpendicularly from the shaft section, the arm section makes contact with the nozzle 60 in the manner of covering from above, to prevent the nozzle 60 from moving upward, and thereby to set a limit for upward movement of the nozzle 60. In this case, the shaft section and the arm section are located on the inside of the rotational track of the grindstones 340.

In the case where the upper limit stopping section 7 has the above-mentioned configuration, for example, by adjusting the height of the shaft section to an appropriate height, the upper limit for upward movement of the nozzle 60 can be set to an appropriate height.

In addition, the biasing mechanism 61 may be one that has a spring or the like and biases the nozzle 60 by elasticity of the spring, in place of the described above configuration in which air is supplied from the air supply source 612 to the inside of the air cylinder 610, to thereby bias the nozzle 60.

The present invention is not limited to the details of the above described preferred embodiment. The scope of the invention is defined by the appended claim and all changes and modifications as fall within the equivalence of the scope of the claim are therefore to be embraced by the invention.

What is claimed is:

1. A grinding apparatus comprising:

a chuck table configured and arranged to hold a workpiece on a holding surface;

a grinding unit including a mount and a grinding wheel that has grindstones arranged in an annular pattern on a wheel base of the grinding wheel, wherein the grinding wheel is connected to an end of the mount, and wherein the grinding wheel is configured and arranged to be rotated about an axis, defined as the center of the wheel base, to grind the workpiece held on the holding surface;

a grinding feeding mechanism configured and arranged to move the grinding unit in a vertical direction perpendicular to the holding surface; and a grinding water supply unit configured and arranged to supply grinding water to a processing area where an upper surface of the workpiece held on the holding surface and a lower surface of the grindstones make contact with each other, wherein the grinding water supply unit includes:

a nozzle configured and arranged to jet the grinding water to the grindstones, and a biasing mechanism configured and arranged to bias the nozzle upward, wherein the nozzle is configured to be movable in a downward direction against the bias from the biasing mechanism in association with downward movement of the grinding unit, and wherein the grinding apparatus includes an upper limit stopping section configured and arranged for setting an upper limit position for upward movement of the nozzle when biased upward upwardly by the biasing mechanism, wherein the upper limit stopping section forms a gap through which the grinding wheel is passed, wherein the gap is defined between the nozzle when biased upwardly by the biasing mechanism and the mount of the grinding unit.

2. The grinding apparatus according to claim 1, further comprising:

a lift plate configured and arranged to move the grinding unit in the vertical direction via the grinding feeding mechanism; and a presser member disposed on a lower surface of the lift plate, wherein the presser member is configured and arranged to make contact with a piston rod associated with the nozzle, and to prevent contact between the nozzle and the grindstones, when the grinding unit is lowered.

3. The grinding apparatus according to claim 2, wherein the lift plate is configured and arranged to move in the vertical direction while being guided by a pair of vertically extending guide rails.

* * * * *